United States Patent [19]

Hoffman

[11] Patent Number: 4,930,775

[45] Date of Patent: Jun. 5, 1990

[54] METHOD OF PLAYING A BOWLING GAME

[75] Inventor: John R. Hoffman, Elburn, Ill.

[73] Assignee: Brunswick Corporation, Skokie, Ill.

[21] Appl. No.: 350,087

[22] Filed: May 10, 1989

Related U.S. Application Data

[63] Continuation-in-part of Ser. No. 118,250, Nov. 9, 1987, abandoned.

[51] Int. Cl.[5] ..... A63D 3/00

[52] U.S. Cl. ..... 273/37

[58] Field of Search ..... 273/37, 54 C

[56] References Cited

U.S. PATENT DOCUMENTS 3,153,538 10/1964 Rogers ..... 273/43 D
3,212,780 10/1965 Jewell ..... 273/54 C
3,529,824 9/1970 Walch ..... 273/54 R

FOREIGN PATENT DOCUMENTS 809541 4/1969 Canada ..... 273/54 C

*Primary Examiner*—Anton O. Oechsle
*Attorney, Agent, or Firm*—Wood, Phillips, Mason, Recktenwald & Vansanten

[57] ABSTRACT

A method of playing a bowling game in which players are allowed at least one ball to knock down pins in each of a plurality of turns of play beginning with a given or beginning pin setup. Each player is required to deliver at least one ball in each of a succession of the given pin setups during a first turn of play until the player fails to knock down a given number of pins in one of the given pin setups. As play continues, at least one pin from the beginning pin setup is eliminated to define a further turn of play of a pin setup having a reduced number of pins. The number of consectuve times in which each player has knocked down at least one pin is recorded. The winner of the game is to be the player having the highest score in terms of consecutive strings in which that player knocked down at least one pin, as accumulated during the play of the game.

15 Claims, 1 Drawing Sheet

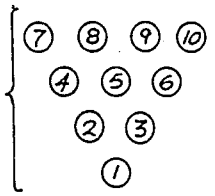
FIG. 1
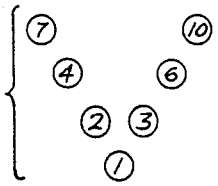
FIG. 2
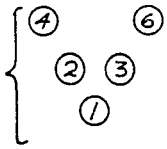
FIG. 3
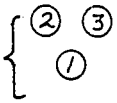
FIG. 4
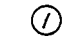
FIG. 5
FIG. 6
| NAME | 1 | 2 | 3 | 4 | ~~5~~ | ~~6~~ | ~~7~~ | ~~8~~ | ~~9~~ | ~~10~~ | TOTAL |
|---|---|---|---|---|---|---|---|---|---|---|---|
| 1 JONES | 6 | 5 | 2 | 0 | | | | | | | 13 |
| 2 SMITH | 5 | 5 | 7 | 2 | | | | | | | 19 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

CROSS REFERENCE

This application is a continuation-in-part of my copending application Ser. No. 118,250 entitled "Method of Playing a Bowling Game" filed Nov. 9, 1987, now abandoned.

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a definite need for new methods of playing a bowling game which are easier to understand and learn and, accordingly, to play; for games which are more exciting during the entire play of the game; for games which are challenging but not difficult; and for games to increase and enhance the public interest in the sport. This invention is directed to satisfying these needs and to rectifying problems inherent in the conventional method of playing a bowling game. In addition, the method of playing a bowling game according to the invention herein is very amenable for helping novice or beginner bowlers in playing the game to a degree of satisfaction.

SUMMARY OF THE INVENTION

An object of the invention, therefore, is to provide a new method of playing a bowling game in which players are allowed at least one ball to knock down pins in each of a plurality of pin setups defining turns of play.

The method generally includes requiring each player to deliver at least one ball in each of a plurality of differing pin setups defining distinct turns of play. A beginning or given pin setup defines a first turn of play. Each player is required to deliver at least one ball in each of a succession of the given pin setups during the first turn of play until the player fails to knock down a given number of pins in one of the given pin setup. At least one pin from the beginning or given pin setup is eliminated to define a second turn of play, and so on through a plurality of turns of play of differing pin setups which are made more difficult by progressively eliminating pins. The number of consecutive times in which each player has knocked down at least one pin during each turn of play is recorded. The winner of the game is declared to be the player having the highest score in terms of consecutive "knock downs" during the play of the game.

An added step of the method may be to eliminate any player who delivers a "gutter" ball during his attempt to achieve a consecutive string of successful pin setups. In addition, the players may be required to deliver their respective balls in turn during the course of the game.

In the exemplary embodiment of the invention, the beginning or given pin setup consists of the "1", "2", "3", "4", "6", "7" and "10" pins to define a first turn of play. It can be seen that the more difficult "5", "8" and "9" pins initially are eliminated from a conventional ten-pin setup. After each player has taken his turn to knock down at least one pin in as many consecutive 1-2-3-4-6-7-10 pin setups as possible in his first turn of play, the "7" and "10" pins are eliminated to define a second turn of play. After that turn, the "4" and "6" pins are eliminated to define a third turn of play. After that turn, the "2" and "3" pins are eliminated, leaving only the "1" pin to define the final pin setup and the final turn of play. In each of the above-described turns of play of any of the pin setups, each player continues to deliver balls to achieve the most consecutive number of times in which at least one ball is knocked down.

Other objects and features of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a representation of a ten-pin setup of a conventional bowling game;

FIG. 2 is a representation of a given initial pin setup according to the method of the invention, to define a first turn of play;

FIG. 3 is a representation of a pin setup to define a second turn of play;

FIG. 4 is a representation of a pin setup to define a third turn of play;

FIG. 5 is a representation of a single-pin setup to define the final turn of play; and FIG. 6 is a conventional bowling game score sheet which might be used in recording the scores of the game.

DETAILED DESCRIPTION OF THE PREFERRED EMBODIMENT

As stated above, conventional bowling games can be quite difficult for a novice or beginning bowler. Not only is the scoring extremely difficult to understand for the novice, but a conventional ten-pin frame setup includes a number of "interior" pins which make a "strike" more difficult.

More particularly, referring to FIG. 1, a conventional ten-pin setup is illustrated. It can be seen that the triangular array of pins includes four rows beginning with a front row having the single "1" pin and terminating in the back row of four pins, the "7", "8", "9" and "10" pins. FIG. 2 shows a given pin setup which might be used with the method of playing a bowling game according to the invention. It can be seen that the "interior" pins, i.e. the "5", "8" and "9" pins have been eliminated from the setup. This seven-pin setup would be highly desirable for the novice or the beginner player because it is easier to knock down all of the pins by a single ball than the conventional ten-pin setup. Of course, other pin setups might be incorporated in the method of playing a bowling game according to the invention.

According to the invention, during play, each player is required to deliver at least one ball in each of a plurality of turns of play of differing pin setups, with the number of pins in the pin setups in each successive turn of play being systematically reduced. Using this general method, and referring back to FIG. 2, each player is required to deliver a ball at the seven-pin setup illustrated. If that player knocks down at least one pin, the seven-pin setup is reset and the player is allowed to again deliver a ball in an attempt to knock down at least one pin. The player continues to deliver balls to arrive at a score indicating the number of consecutive times or the "longest string" of balls delivered at the seven-pin setups until that player fails to knock down at least one pin. The next player then takes his turn at the seven-pin setup of FIG. 2 and continues to roll balls at repeated seven-pin setups until the player fails to knock down at least one pin.

For instance, referring to FIG. 6, assume that a twosome of "Jones" and "Smith" are playing the game. During the first turn of play involving the seven-pin setup of FIG. 2, Jones delivered six consecutive balls at six consecutive seven-pin setups, and failed to knock down a pin on his seventh ball. Jones would be awarded the score of "6" under the "1" column on a standard score sheet as shown in FIG. 6. In Smith's first turn, he delivered five consecutive balls and each time knocked down at least one pin in the seven-pin setup, failing to knock down a pin on his sixth ball. Smith would be recorded a score of "5", as shown. It should be understood that the game could be played by requiring a player to knock down all pins with his ball and to record strings of such "strikes". In addition, other pin setups are contemplated.

After the first turn of play described above in relation to the pin setup of FIG. 2, at least one pin is eliminated from the beginning or given pin setup. For instance, the invention includes a scheme of play in which the "7" and "10" pins are eliminated to define a five-pin setup as illustrated in FIG. 3. In other words, the two outermost pins of the triangular array have been removed to define a second turn of play. Jones and Smith again begin their turn by delivering consecutive balls at consecutive five-pin setups, as illustrated, until they fail to knock down a pin. Assume Jones knocked down at least one pin (or all five pins) in five consecutive deliveries of a ball and failed on his sixth attempt. Jones then would be awarded a score of "5" which would be recorded under column "2" of the score sheet. Smith took his turn and also failed on this sixth ball, resulting in a similar score of "5" for that turn of play.

After the second turn of play defined by the five-pin setup of FIG. 3, again the two outermost pins are removed or eliminated, i.e. pins "4" and "6", to define a third turn of play as shown in FIG. 4 where the "1", "2" and "3" pins remain in the setup in a triangular array. Again, the same game play is repeated during this turn of play. Jones knocked down at least one pin during that third turn of play on only two consecutive balls, failing on his third ball, resulting in a score of "2". Smith had a remarkable string of seven consecutive balls in which he knocked down at least one (or all) of the three pins of the pin setup of FIG. 4, failing to knock down a pin on his eighth ball, resulting in a score of "7".

The fourth or final turn of play is shown in FIG. 5, where it can be seen that again the two outermost pins, i.e. pins "2" and "3", have been eliminated, leaving pin "1" for the final turn of play. Jones delivered his first ball and failed to knock down pin "1", resulting in a score of "0" for that turn of play. Smith, during his turn, knocked down the "1" pin on two consecutive balls, failing on his third ball, resulting in a score of "2" for that turn of play.

It can be seen that Jones achieved a game score of "13" and Smith achieved a game score of "19", with Smith being declared the winner. In other words, the winner of the game is the player who had the highest score in terms of the longest strings in which that player knocked down at least one ball, during each turn of play, and adding the consecutive strings to determine the winner of the game.

Of course, it should be understood that other, differing pin setups can be used than those illustrated in FIGS. 2–5. In addition, the game could start with a ten-pin setup as shown in FIG. 1, and removing the "5", 37 8" and "9" pins before the second pin setup for the second turn of play of FIG. 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed at least one ball to knock down pins in each of a plurality of turns of play beginning with a given pin setup defining a first turn of play, said method comprising:

(a) requiring each player to deliver at least one ball in each of a succession of said given pin setups during the first turn of play until the player fails to knock down a given number of pins in one of the given pin setups;

(b) eliminating at least one pin from said given pin setup to define a subsequent turn of play;

(c) recording the number of consecutive pin setups a player knocks down said given number of pins in each turn of play;

(d) declaring the winner of the game to be the player having the highest score in terms of the number of times that player knocked down pins from the pin setups.

2. The method of claim 1 wherein any player who delivers a gutter ball is eliminated from the game.

3. The method of claim 1 wherein the players deliver their balls in turn during the course of the game.

4. The method of claim 1 wherein at least one pin is eliminated from the pin setup in a predetermined sequence of play until only one pin remains in a final pin setup.

5. The method of claim 4 wherein said given beginning pin setup consists of the "1", "2", "3", "4", "6", "7" and "10" pins to define a first turn of play.

6. The method of claim 5 wherein the "7" and "10" pins are eliminated to define a second turn of play.

7. The method of claim 6 wherein the "4" and "6" pins are eliminated to define a third turn of play.

8. The method of claim 7 wherein the "2" and "3" pins are eliminated to define a final pin setup.

9. The method of claim 4 wherein said elimination step continues throughout a plurality of turns of play of pin setups having reducing numbers of pins.

10. A method of playing a bowling game in which players are allowed at least one ball to knock down pins in each of a plurality of turns of play, said method comprising:

(a) selecting a given, beginning pin setup of a given number of pins, to define a first turn of play;

(b) requiring each player to deliver consecutive balls during said first turn of play at consecutive ones of said given pin setup until each player fails to knock down at least one pin;

(c) recording the number of consecutive times each player has knocked down at least one pin in successive ones of the given pin setups;

(d) eliminating at least one pin from said given pin setup after each player has taken said first turn of play, to define a second turn of play;

(e) requiring each player to deliver consecutive balls during said second turn of play at consecutive ones of the pin setup of the second turn of play until each player fails to knock down at least one pin;

(f) recording the number of consecutive times during the second turn of play in which each player has knocked down at least one pin;

(g) adding each player's scores for each turn of play to determine said player's total score for the game; and (h) comparing the players'game scores to determine the winner of the game.

11. The method of claim 4 wherein said given beginning pin setup consists of the "1", "2", "3", "4", "6", "7" and "10" pins to define said first turn of play.

12. The method of claim 11 wherein the "7" and "10" pins are eliminated to define said second turn of play.

13. The method of claim 12 wherein the "4" and "6" pins are eliminated to define a third turn of play.

14. The method of claim 13 wherein the "2" and "3" pins are eliminated to define a final pin setup.

15. A method of playing a bowling game in which players are allowed a number of balls to knock down pins in each of a plurality of pin setups, said method comprising:

(a) selecting a beginning pin setup consisting of the "1", "2", "3", "4", "6", "7" and "10" pins;

(b) requiring each player to deliver at least one ball in each of a succession of said beginning pin setups until the player fails to knock down a given number of pins in a pin setup;

(c) recording the number of consecutive pin set-ups in which each player has knocked down said given number of pins; and (d) declaring the winner of the game to be the player having the longest consecutive string of pin setups in which that player knocked down said given number of pins.

* * * * *